United States Patent [19]

Fapiano

[11] 4,126,026

[45] Nov. 21, 1978

[54] METHOD AND APPARATUS FOR PROVIDING IMPROVED AUTOMATIC GAGE CONTROL SETUP IN A ROLLING MILL

[75] Inventor: Donald J. Fapiano, Salem, Va.

[73] Assignee: General Electric Company, Salem, Va.

[21] Appl. No.: 836,725

[22] Filed: Sep. 26, 1977

[51] Int. Cl.[2] ..... B21B 37/08
[52] U.S. Cl. ..... 72/6; 72/14
[58] Field of Search ..... 72/6–8, 72/14, 365, 366

[56] References Cited

U.S. PATENT DOCUMENTS

| | | | |
|---|---|---|---|
| 3,890,817 | 6/1975 | Beeston et al. | 72/6 |
| 3,906,764 | 9/1975 | Mueller | 72/8 |

*Primary Examiner*—Milton S. Mehr
*Attorney, Agent, or Firm*—Arnold E. Renner

[57] ABSTRACT

A method and apparatus for determining the initial opening of a pair of opposed work rolls utilized to reduce the thickness of a metal workpiece provides that selected readings of the roll separation force occasioned by passage of the workpiece through the rolls on a next preceding pass are utilized to determine the initial roll opening setting for the next pass of the workpiece between the rolls. The readings selected differ in accordance with a determination of whether or not the next pass is to employ automatic gage control.

8 Claims, 5 Drawing Figures

METHOD AND APPARATUS FOR PROVIDING IMPROVED AUTOMATIC GAGE CONTROL SETUP IN A ROLLING MILL

BACKGROUND OF THE INVENTION

The present invention relates generally to metal rolling mills having automatic gage control capabilities and more particularly to an improved method and apparatus for determining the initial roll opening of such a mill when automatic gage control is to be utilized.

Metal rolling mills employ a pair of opposed rolls through which a piece of metal, hereinafter referred to as a workpiece, is passed to reduce the metal in thickness. Prior to the passing of the workpiece, however, the mill must undergo what is commonly called a "setup." That is, the basic operating parameters of the mill must be determined. In most modern mills, the setup is under the control of a computer which is supplied with statistical data of many types in order to determine the operating parameters. As an example of the computer controlled mill, reference is made to U.S. Pat. No. Re. 26,996, "Computer Control Systems for Metals Rolling Mill" by R. G. Beadle et al, issued Dec. 8, 1970 and assigned to the assignee of the present invention.

One of the most basic determinations that must be made in any mill setup, particularly in the case of a single stand reversing mill such as will be more fully described hereinafter, is that of the initial unloaded roll opening; that is, the spacing between the rolls in the unloaded condition which occurs prior to the entry of the workpiece between the rolls. It is well known that the unloaded roll opening is less than the thickness or gage of the workpiece that will emerge from between the rolls in the rolling process. This is because the mill stand is not a perfectly rigid apparatus and it does exhibit what is known as "stretch." Because the mill stand is not perfectly rigid, when the metal workpiece is between the rolls the forces occasioned by the rolling spread the rolls apart by some amount. There are many known methods and techniques for determining the initial roll opening. All, however, employ the same basic considerations which normally include: (1) the desired output thickness, (2) the mill stretch, (3) the material composition and temperature, (4) the workpiece width and (5) the effective roll crown.

The normal prime objective of any rolling operation is to produce "on gage" material; i.e., a sheet of metal which is of the desired thickness throughout its length. In a single stand reversing finishing mill, the workpiece is passed repeatedly in opposite directions through a single pair of work rolls with the unloaded roll opening being successively reduced so as to repeatedly take reductions in the thickness of the workpiece. In such mills, the concept of automatic gage control (AGC) has long been known and employed. It has for many years been recognized that the force separating the rolls can be related to thickness reduction and further that a measurement of this force can be used to adjust the rolls while the metal is actually being rolled to thereby improve the control of the output gage. As examples of this fundamental knowledge, reference is made to U.S. Pat. No. 2,726,541, "Measuring Apparatus For Rolling Or Drawing Sheet Or Strip Metal" by R. B. Sims, issued Dec. 13, 1955 and to U.S. Pat. No. 2,680,978, "Production Of Sheet and Strip" by W. C. F. Hessenberg et al, issued June 15, 1954.

Two basic types of AGC are known today. These are commonly referred to as the "lock-on" system and the "absolute" system. In the lock-on system, the first observed gage is used as a reference and the adjustments to the roll opening are made using this first observed reading as the reference point. For reasons which will be more apparent as this description proceeds and particularly with respect to the description of FIG. 3, because the ends of the workpiece are normally of lesser thickness than the central portion, it is quite easy for the lock-on system to reference an incorrect gage and thus roll the complete workpiece "off gage." It is possible, in the lock-on system, to wait until a fair amount of material has passed through the rolls before taking the reference reading. This, obviously, results in an off gage portion near the end of the workpiece which results in waste. The absolute system employs a preestablished value which is used as a reference point. Because of entry shock, however, it is necessary to delay at least 0.1 seconds before initiating the gage control, and, because of limitations in the speed of response of the roll gap positioning system, another 0.2 seconds or more will elapse before any significant gage correction results. Thus, once again waste is potentially inherent in the system. As an example of the absolute system, reference is made to U.S. Pat. No. 3,906,764, "Rolling Mill Control Method And Apparatus" by G. E. Mueller, issued Sept. 23, 1975.

Regardless of the type of system, lock-on or absolute, and the present invention may be used with either basic system, the initial setup referred to above is provided. In the prior art, this initial setup, roll opening in this particular instance, is based upon the evaluation of force readings made on the next preceding pass taken throughout the main body portion of the workpiece and ignores the end portions because of the relatively extreme deviations therein. Thus, there is a strong possibility of a relatively large percentage of waste when it is considered that the total finished length of a workpiece after rolling in a single stand reversing finishing mill may be typically 100 to 150 feet and often less than 60 feet. Thus, if the entry rolling speed is 11 feet per second, as is typical and as was indicated for the absolute system, three-tenths of a second is lost, then it is seen that some 3 to 4 feet may be lost at the end of the piece which is off gage and may wind up as waste.

One additional general point should be made with respect to systems employing AGC. In a mill employing this system, the total reduction from the initial to the final thickness may take several passes through the mill. It is not unusual for a single workpiece to be passed through the stand eleven or twelve times in this process. The automatic gage control feature, when available, is not normally used at all times but is used in the later passes where, customarily, the amount of reduction is relatively less. That is, in the earlier passes of the workpiece through the roll, a heavier reduction will be taken and AGC is not used although setup is employed in each case. As the workpiece nears the end of its rolling schedule, the amount of reduction taken during a single pass is reduced and the AGC system may be employed in the last three or four passes.

SUMMARY OF THE INVENTION

It is, therefore, an object of the present invention to provide an improved method and apparatus for setup of a rolling mill utilizing automatic gage control.

It is a further object to provide for improved automatic gage control which utilizes the basic capabilities of existing type systems with minimal additional requirements.

It is a further object to provide an improved setup for automatic gage control through the provision of roll force separation readings taken in an area of the workpiece normally ignored.

The foregoing and other objects are achieved in accordance with the present invention by providing, in a metal rolling mill, for the measurement of the roll separation force as a workpiece is passed between the rolls. Values representing the force measurements at two different areas or regions are stored and, in accordance with the mode of operation of the next pass of the workpiece, selected stored values are used to effect the setup of the roll opening depending upon whether or not the next pass is to employ AGC.

BRIEF DESCRIPTION OF THE DRAWING

While the present invention is described in particularity in the claims annexed to and forming a part of this specification, a better understanding of the invention can be had by reference to the following description taken in conjunction with the accompanying drawing in which:

DETAILED DESCRIPTION

Figure 1:
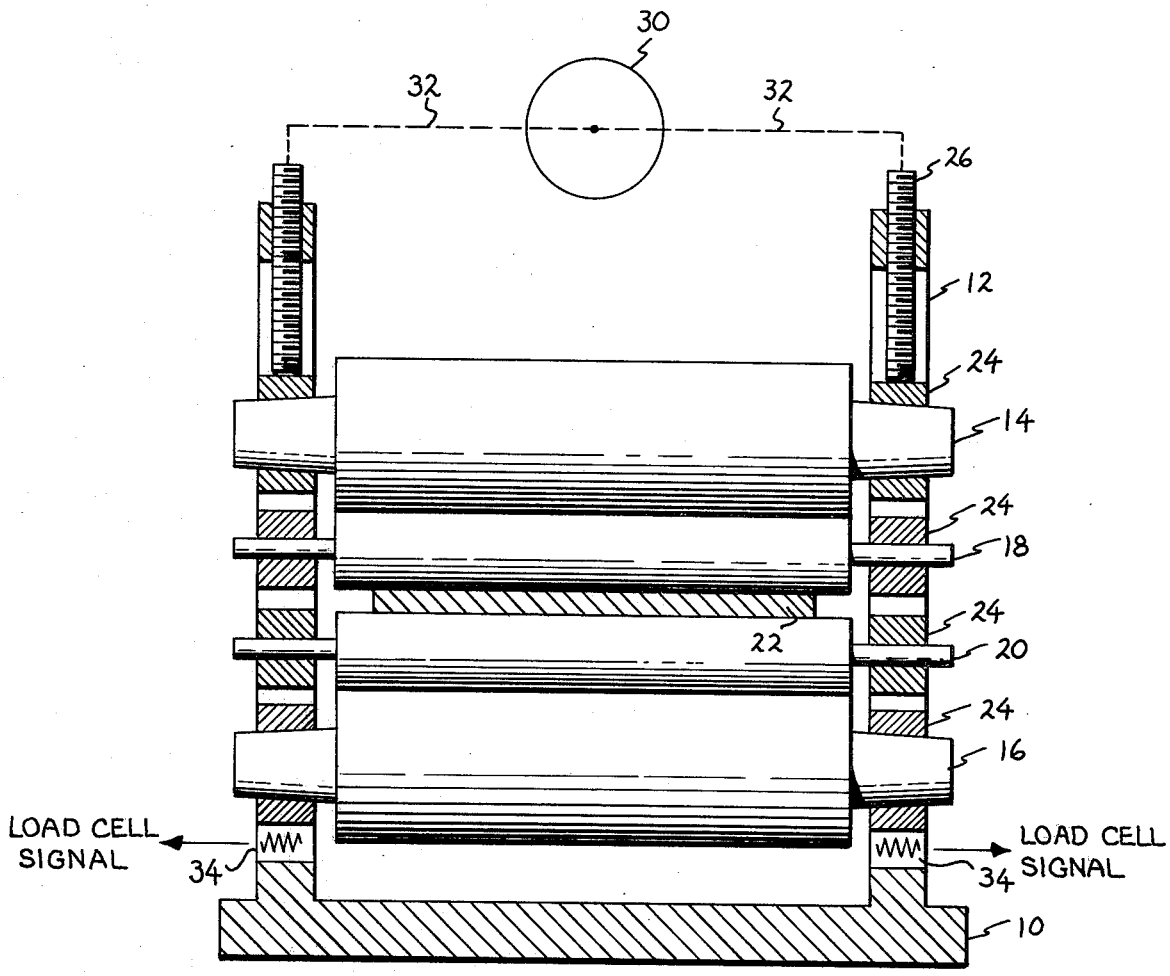
FIG. 1 is a diagrammatic view, partially in section, illustrating a typical four-high mill stand such as might be used with the present invention.

Referencing now FIG. 1, there is shown a typical four-high mill stand such as is well known in the art. The stand includes a base 10 and a pair of upright portions 12 to support the rolls of the stand. In that this is a four high stand, there are included an upper backup roll 14 and a lower backup roll 16 and well as upper and lower work rolls 18 and 20, respectively. A workpiece 22 is passed between the work rolls 18 and 20 to effect a reduction in the thickness of the workpiece. Each of the rolls 14, 16, 18 and 20 is supported for rotational and vertical linear motion by means of appropriate bearing chocks 24. The position of the rolls is determined by suitable means which is illustrated in FIG. 1 as a pair of screws 26 which are supported by the upper part 28 of the stand. The position of the screws is determined by a suitable means illustrated as a motor 30 which is mechanically connected to the screws as illustrated by the dashed lines 32. Thus, under the setup control, the motor serves to drive the screws so as to change the effective roll opening between the work rolls 18 and 20 all in a manner well known in the art. Other means for adjusting this opening are well known and quite often the system used is a hydraulic one.

As the workpiece 22 is passed between the rolls 18 and 20, forces are exerted on the rolls which may be measured. In the present embodiment this measurement is provided by a pair of load cells 34 located between the base 10 and the chocks 24 of the lower backup roll 16. The load cells 34 are customarily some form of strain gage which outputs a signal proportional to the forces exerted thereon. In FIG. 1, this output is indicated by the designation "load cell signal." It is known that the load cells can be located in other positions. They are, for example, often located between the bottom of the screws 26 and the chock 24 of the upper backup roll 14. The position of the load cells 34 is not critical to the present invention except insofar as to provide an output signal which is proportional to the roll separation force when the workpiece 22 is being passed between the work rolls 18 and 20. It is also noted that while a four-high stand has been shown, it is known in the art to provide what is known as a two-high stand in which there are no backup rolls and in which there are but a single pair of work rolls (normally of proportionately greater diameter than here shown). Whether or not the stand is a two-high or a four-high is of no direct importance to the present invention and this invention has equal applicability to either type of known mill stand.

Figure 2:
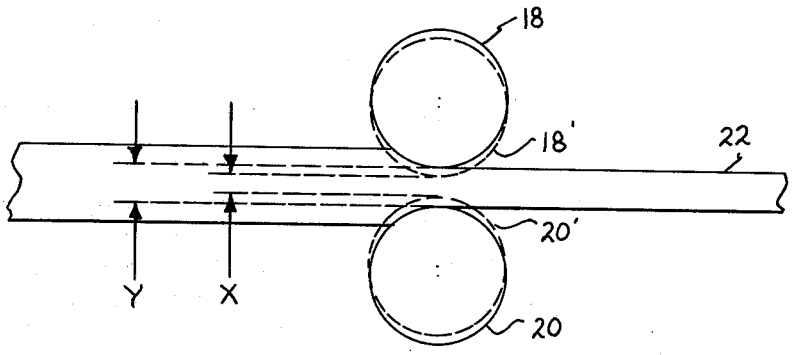
FIG. 2 is a diagrammatic view illustrating a metal thickness reduction and the concept of mill stretch.

FIG. 2 diagrammatically illustrates what happens to the rolls when the workpiece 22 is being rolled. As shown in FIG. 2, the workpiece 22 enters between the rolls 18 and 20 and emerges therefrom at a lesser thickness than its entry thickness or gage. The dashed line depiction of the rolls 18' and 20' shows in exaggerated form the position of the rolls in their unloaded state; that is, before entry of the workpiece 22 therebetween. It is seen from this depiction that as the workpiece 22 enters between the rolls, they are forced to part to an extent due to the fact, as previously mentioned, that the mill stand is not a perfectly rigid structure. Thus, as shown, the distance X would be the unloaded roll opening while the distance Y would be the loaded roll opening. The mill stretch would be equal to the difference between the values of X and Y.

Figure 3:
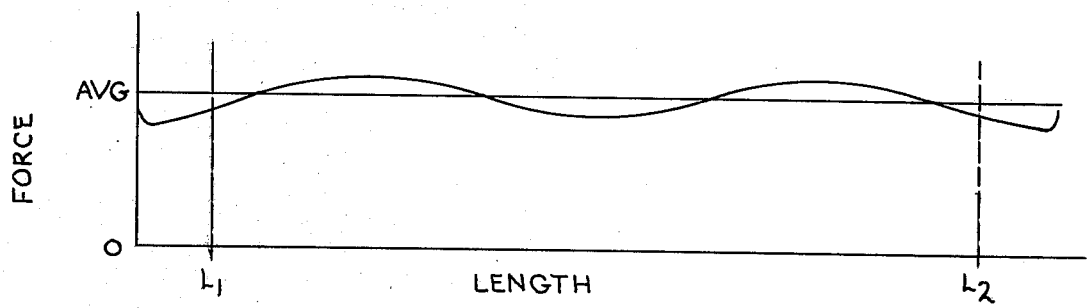
FIG. 3 is a typical force profile obtained as a workpiece is being rolled.

FIG. 3 illustrates a typical force profile such as would be obtained by the plotting of the values of the signals from the load cells 34 (FIG. 1) as the workpiece 22 makes a single pass through the rolls. The variations in force which are illustrated along the length of the workpiece may be due to a variety of factors, but the primary cause of this variation is the fact that the workpiece is not of uniform temperature along its total length. It is well known that as a general rule, with a given composition of material, less force is required to achieve a given reduction at higher temperatures than at lower temperatures. Thus, within the portion between $L_1$ and $L_2$ as shown in FIG. 3, the two humps or higher readings would normally represent an area of lower temperature such as might be occasioned by so-called skid marks along the length of the material. These skid marks result from the fact that as the material is pushed through a furnace which precedes the rolling mill, it rides along two tracks and the workpiece tends to be cooler where it is in contact with those tracks. It is also shown in FIG. 3 that the slab tends to show a high degree of inconsistency or nonuniformity near each of the ends. This is the result not only of temperature but also the fact that as you approach the ends there is a lesser amount of material to prevent deformation and thus the shear forces required near the end tend to be less. The sharp upturn which is seen at each end of the material is primarily the result of the fact that the very end of the material will tend to be cooler than that which has surrounding metal on both sides.

Due to the large variations which prevail near each end, it has been the practice, in the prior art, to take force readings within the area defined by the region $L_1$ to $L_2$ to develop the setup or the roll opening for the next pass. This was done by taking periodic readings along the length of the material between $L_1$ and $L_2$ as it is being rolled and averaging these readings to give an average force value as indicated by the line so marked. This value is then related to thickness in accordance with the factors such as temperature, material hardness, etc. and combined with mill stretch and any crown correction to arrive at a value of the roll opening for the next pass, whether or not AGC was to be employed.

Figure 4:
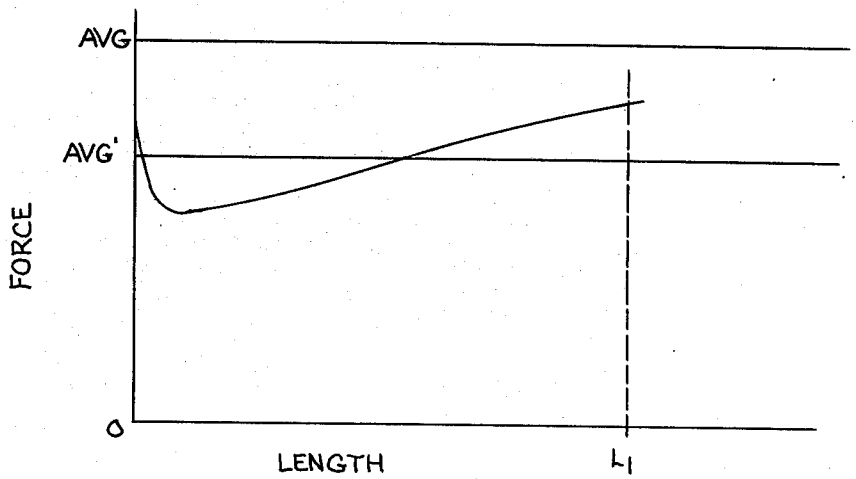
FIG. 4 is an enlargement of a portion of the profile of FIG. 3.

FIG. 4 illustrates an enlargement of that portion of the FIG. 3 curve between 0 and $L_1$. The sharp upturn near the end of the material is more readily seen in this enlarged view and it is further seen that the average force value of the readings taken between $L_1$ and $L_2$ (FIG. 3) is somewhat higher in value than an average (AVG') taken of the portion from 0 to $L_1$. It is this second average, i.e., AVG', that is used in the implementation of the present invention. The region represented by the length $L_1$ to $L_2$ is referred to as a first or normal control portion or region while that represented by force readings taken along the length 0 to $L_1$, i.e., the trailing portion of the workpiece as it leaves the stand, is referred to as the second control portion or region.

Much has been said about the unloaded roll opening. This opening may be determined in a number of ways but is, essentially, the result of the desired gage less the expected stretch of the mill plus any correction factors which are included in the setup model such as screw offset and crown offset. Screw offset is an error which is cmpirically observed and amounts to a correction factor while crown offset is compensation for the roll crown as it affects the gage. As an example of crown offset, reference is made to U.S. Pat. No. 3,625,036, "Gage Control Method Including Consideration Of Plate Width Effect On Roll Opening" by D. J. Fapiano, issued Dec. 7, 1971. The expected stretch of the mill which was briefly discussed with respect to FIG. 2 is a function, for a given mill, of a variety of factors, primarily the material composition, temperature, thickness and width.

Figure 5:
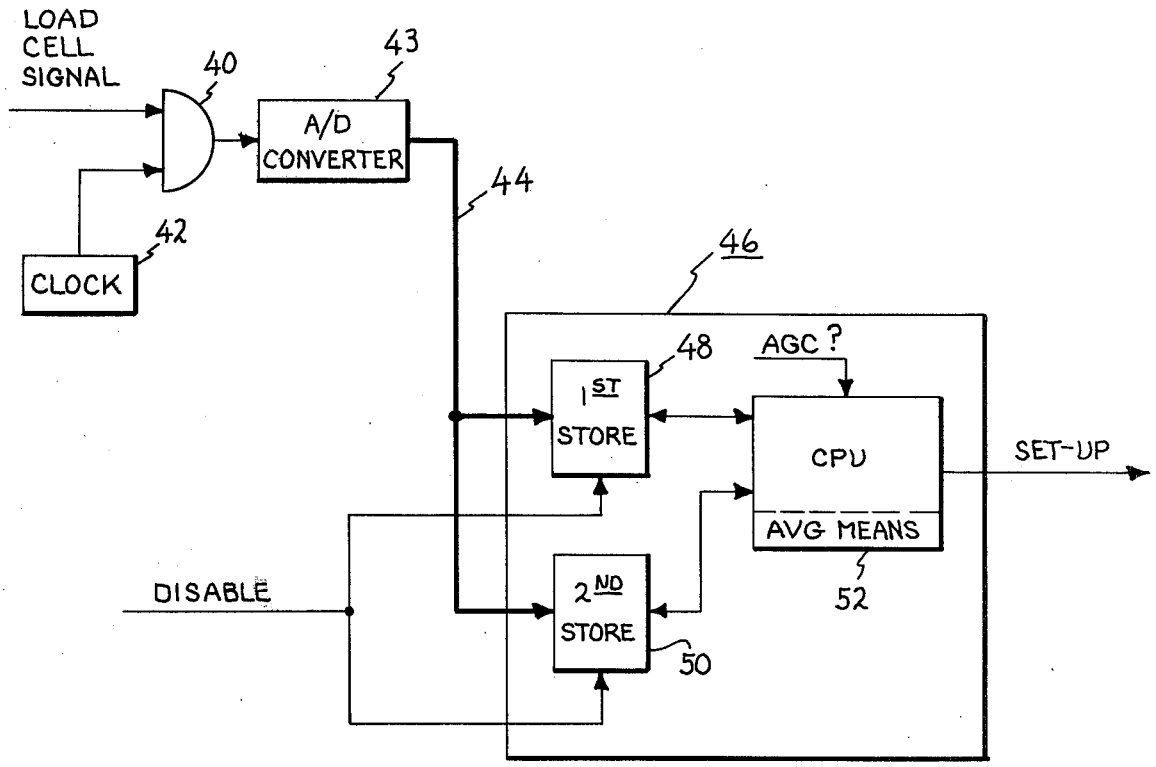
FIG. 5 is a schematic diagram illustrating the present invention in its preferred embodiment.

FIG. 5 schematically illustrates the preferred embodiment of the present invention. As shown in FIG. 5, the load cell signal forms one input to an AND gate 40 the second input of which is the output of a clock 42. The load cell signal would be derived from, for example, the cells 34 of FIG. 1 and would normally be the average of those two signals. The clock 42 outputs a series of pulses which would occur at some predetermined rate, typically 30 to 50 pulses per second. Thus, the output of gate 40 will be, because the load cell signal is an analog signal, a series of pulses at the repetition rate of the clock 42 with each pulse having a magnitude corresponding to the load cell signal; i.e., proportional to the extant value of the force as the workpiece is passed between the rolls. The output of AND gate 40 is applied to a conventional analog to digital converter 43 which outputs by way of bus 44 a digital signal representing the value of its instantaneous input signal. These digital values are applied to any appropriate computer or data processing unit indicated generally by block 46. A Honeywell 4000 Series computer is a suitable example. The use of such computers in total mill control is well known and the details are not important to the present invention. As such only the salient portions which have relevance to the present invention have been illustrated.

The digital signals appearing on bus 44 are provided to each a first and a second store means within the computer 46. A central processing unit (CPU) would govern the storing of these signals representing the force values all in a manner well known in the art. The first store 48 could be, for example, a read/write memory and the values placed therein would normally be those, as is common in the prior art, which occur within the region $L_1$ to $L_2$ (FIG. 3). The second store 50 is, in the preferred embodiment of the present invention, a store of limited capacity and one which operates in a stack arrangement such that it holds only a limited number of values. When the number of values applied thereto exceeds its capability the first value applied thereto is lost. Typically, the second store is called an open-end shift register. Thus, it is seen that the second store 50 will contain only a prescribed number of signals applied thereto by way of bus 44 in accordance with the designed capacity of the store 50. In the present embodiment of the invention being described, the store 50 has twelve locations and, therefore, the last 12 readings which were made are stored in the store 50. Relating this to FIG. 3, the twelve readings would be those occurring along workpiece length 0 to $L_1$.

For purposes of illustration, each store is furnished a "disable" signal to inhibit further readings from being stored. The "disable" signal would normally originate with some appropriate sensor associated with the mill stand such as a presence sensor which would sense the tail end of the workpiece leaving the mill. It could also be derived from a determination that the load cell signal had gone to substantially zero.

From the description thus far, it is seen that as the workpiece passes through the rolls, there are stored in the first store 48 a number of values which relate to the forces observed as a workpiece passed the rolls in the normal control region ($L_1$ to $L_2$ of FIG. 3). A relatively smaller number of readings (12 in the present example) corresponding to the values of the readings taken as the trailing end of the workpiece left the mill are stored in the second store 50. These readings correspond to the values taken between 0 and $L_2$ of FIG. 3. The values stored in the two stores are used to compute force values which are used in turn to determine the setup roll opening of the next pass of the workpiece through the mill in accordance with the type of operation to be performed. As shown in FIG. 5, the CPU 52 is provided with a signal "AGC?". This signal would, in normal instances, be a part of the overall model program of the computer which would determine whether AGC is to be used on the next pass. It could also be an input from the operator who determines whether or not the pass is to employ AGC. CPU 52 includes an averaging means which forms a part of the arithmetic capability of the CPU. In accordance with the present invention, if the next pass of the workpiece through the rolls is not to employ AGC, then in response thereto to this indication, the CPU would access store 48 withdrawing those values stored corresponding to the normal control region ($L_1$–$L_2$) and take an average of those readings to be used in computing the roll opening to be used on the next pass in accordance with the known present day methods. It would then provide, as an output signal indicated as "setup," this signal to the control (not shown) of the motor 30 to set the screws and hence the unloaded roll opening. This computed value would normally also be utilized to update the overall model of the mill in accordance with existing standard practice.

When AGC is to be employed, a different method for computing the roll opening is employed. When it is decided that the next pass will be under AGC control, the values stored in the second store 50 are used; that is, the values relating to the trailing end of the workpiece as it left the rolls on a preceding pass. While the overall program may still take an average of the main control portion $L_1$–$L_2$ for purposes of updating as was done previously, in the preferred embodiment of the present invention, only those readings in the second store are utilized in determining the roll opening setup. Thus, in response to an indication of AGC being used on the next pass, CPU 52 will access the second store 50, retrieve the readings therein retained and by means of the averaging means develop a value which is proportional to the average force only of those readings. This average value is then used to determine the unloaded roll opening setting for the next pass of the workpiece to the metal.

An alternate method of computation which achieves identical results utilizes the values in both stores. In this method, in that the calculation for normal updating procedures would be made from readings of the control region $L_1$–$L_2$, the values are averaged as before and that average value is stored. A second average is then taken using limited number of values in the second store 50 and this average is then subtracted from the first average to develop an offset. This offset is utilized to adjust the roll opening from the value initially determined to achieve the final roll opening for setup in anticipation of the next pass which will employ AGC. It is seen, however, that the result is identical to that achieved in the first instance. The only reason one might have preference over the other is because of certain overall computer program control operations which would make one mode of operation preferable over the other.

Once the initial roll opening has been established, the workpiece is passed through the rolls and the AGC is allowed to function in either the lock-on or the absolute modes previously described and the gage is controlled in accordance with the new setup opening to achieve an improved gage which compensates for the customary end deviations of the workpiece and will, therefore, result in less waste of material.

Thus, there has been shown and described an improved setup method for an automatic gain control system which is accurate and reduces waste and which requires only a minimum amount of additional capability to achieve these results.

While there have been shown and described what are at present considered to be the preferred embodiments of the present invention, modifications thereto will readily occur to those skilled in the art. It is not desired, therefore, that the invention be limited to the specific circuit shown and described and it is intended to cover in the appended claims all such modifications as fall within the true spirit and scope of the invention.

What is claimed is:

1. In a metal rolling mill for reducing the thickness of a metal workpiece by successive passes of the workpiece through opposed work rolls, said mill being of the type including automatic gage control which may be rendered active on a selective basis during prescribed ones of said passes, an improved system for determining the initial roll openings for each of said passes after the first including:

(a) means for measuring the roll separation force during a pass of the workpiece between the rolls and for providing force signals indicative of the instantaneous values of said force;

(b) first store means for periodically storing the values of said force signal while a first control portion of said workpiece is between said rolls;

(c) second store means for periodically storing the value of said force signal while a second control portion, including the trailing end of said workpiece, is between said rolls; and, (d) computation means responsive to selected values stored in said first and second store means to calculate the roll opening setting for the next pass of the workpiece between said rolls, said computation means employing only those values stored in said first store means when the mill is not to be operated under automatic gage control and employing the values stored in said second store when the mill is to be operated with auomatic gage control.

2. The invention in accordance with claim 1 wherein said second store means includes an open ended shift register for retaining a prescribed number of the last force signal values.

3. The invention in accordance with claim 1 wherein said computation means includes means for computing the average value of the stored force signal values from said first and said second store means in accordance with the mode of mill operation to be utilized on the next pass.

4. The invention in accordance with claim 1 wherein said first recited means provides analog force signals and further including analog-to-digital conversion means for converting said analog signals to digital representations for storage in said store means.

5. In the operation of a metal rolling mill of the type having opposed rolls for reducing the thickness of a metal workpiece passed therebetween and further including selectively employed automatic gage control, a method of determining the opening at which said rolls are set prior to the initiation of a rolling pass comprising the steps of:

(a) measuring the force tending to separate the rolls while the workpiece is passed between said rolls;

(b) producing a plurality of signals each proportional in value to the instantaneous magnitude of said force at periodic times while said workpiece is passing between said rolls;

(c) storing, in a first store, the value of those signals corresponding to a first control portion of said workpiece;

(d) storing, in a second store, the values of those signals corresponding to a second control portion of said workpiece, said second control portion including the trailing portion of said workpiece as it leaves said rolls;

(e) determining whether or not the next rolling pass is to employ automatic gage control; and, (f) determining the initial roll opening setting for the next pass of the workpiece through the rolls using, selectively, the values stored in the first and second stores in accordance with said determination of whether or not the next rolling pass is to employ automatic gage control.

6. The invention in accordance with claim 5 wherein the step of determining the initial roll opening includes the steps of:

(a) averaging, when the next pass through the rolls is not to employ automatic gage control, the values stored in said first store for use in determining the initial roll opening for the next pass of the workpiece through the rolls; and, (b) averaging, when the next pass through the rolls is to employ automatic gage control, the values stored in said second store for use in determining the initial roll opening for the next pass of the workpiece through the rolls.

7. The invention in accordance with claim 5 wherein the step of determining the initial roll opening includes the steps of:

(a) averaging the values stored in the first store for use in determining a base roll opening setting; and, (b) modifying the base roll opening by an incremental adjustment when the next pass is to include automatic gage control, said incremental adjustment being derived by averaging the values stored in the second store means for use in determining said incremental adjustment.

8. The invention in accordance with claim 5 wherein the step of determining the initial roll opening includes the steps of:

(a) averaging the values stored in the first store for use in determining a base roll opening setting;

(b) averaging the values stored in the second store for use in determining an incremental adjustment value; and, (c) combining said incremental adjustment value to said base roll opening setting to arrive at an actual roll opening setting.

* * * * *